United States Patent [19]

Ryser

[11] 4,342,976

[45] Aug. 3, 1982

[54] PULSE TRANSFORMER

[75] Inventor: Heinrich Ryser, Schliern, Switzerland

[73] Assignee: Hasler AG, Bern, Switzerland

[21] Appl. No.: 228,155

[22] Filed: Jan. 23, 1981

[30] Foreign Application Priority Data

Feb. 1, 1980 [CH] Switzerland ..... 814/80

[51] Int. Cl.[3] ..... H01F 15/04; H01F 27/28

[52] U.S. Cl. ..... 336/84 C; 336/200; 336/205; 336/223

[58] Field of Search ..... 336/200, 180, 84 R, 336/84 C, 221, 220, 222, 223, 229, 205, 206

[56] References Cited

U.S. PATENT DOCUMENTS 3,102,245 8/1963 Lawson, Jr. ..... 336/223 X 4,249,229 2/1981 Hester ..... 336/200 X

*Primary Examiner*—Thomas J. Kozma

*Attorney, Agent, or Firm*—Brady, O'Boyle & Gates

[57] ABSTRACT

The pulse transformer consists of a closed toroidal core (30), the primary winding (31) and secondary winding (32) of which are fashioned as multilayer, flexible printed circuit boards. These circuit boards have the shape of flat strips and are bent into loops. By means of pins (36–39 and 46–49, respectively), they are connected mechanically and partially electrically to a supporting printed circuit board (11). The pins connect the conductor tracks of the central layer of the flexible printed circuit boards with respectively one winding, whereas the upper and lower conductive layers shield the windings against electromagnetic interferences coming from the outside.

The pulse transformer is suitable as an isolation transformer for the transmission of rapid digital signals arriving, for example, via a coaxial line (20).

10 Claims, 7 Drawing Figures

PULSE TRANSFORMER

Figure 1:
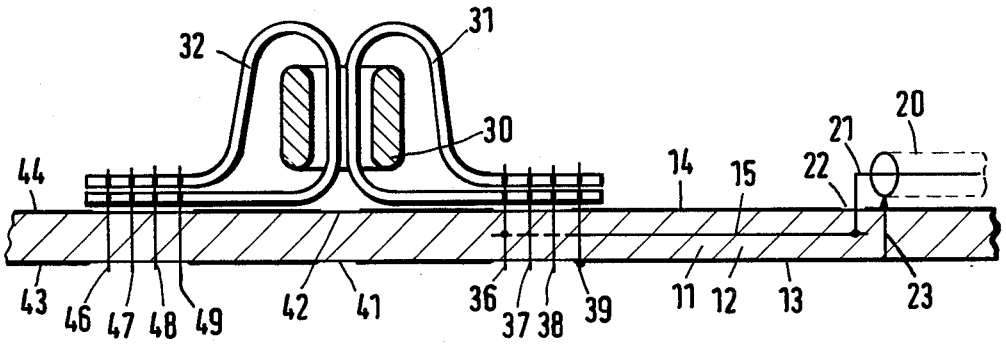

The invention relates to a pulse transformer with a toroidal, seamlessly closed core and with primary and secondary windings, wherein the turns of the windings are formed from elongated conductors applied in parallel side-by-side relationship to flexible, plate-shaped substrates of an insulating material, wherein the substrates together with the conductors are passed through the core and bent together into a loop, and wherein the ends of the conductors are electrically connected with one another.

Pulse transducers, also called pulse transformers, are to be compact and are to exhibit good transmission properties, meaning above all rapid pulse rise and decay times. This leads to the preferred use of closed, seamless toroidal cores as the transformer core. However, such toroidal cores have the disadvantage that the windings cannot be mounted in a way favorable for their operation.

Pulse transformers are being offered on the market at present wherein the wire turns are constituted by U-shaped wire brackets joined into "windings" by soldering together with conductor tracks of a supporting printed circuit board, which tracks are arranged in a stellate fashion (described, for example, by the publication No. FR-A-2,394,878). Furthermore, pulse transformers are known wherein magnetic material is introduced in a special way into the central, concentric aperture of the primary and secondary windings, so that a completely transformative transducer is obtained. A similar version is disclosed in the reference U.S. Pat. No. 3,659,240, according to which two coils and thus a complete pulse transformer are created by successive application of thick-film conductor segments onto a closed magnetic core.

Finally, a transducer is known from IBM Technical Disclosure Bulletin, vol. 12, issue 6, November 1969, New York, wherein a flexible supporting plate of insulating material with several parallel conductive tracks mounted thereon serves for the formation of a coil. The supporting plate is, for this purpose, pulled together with the conductor tracks through the rectangular core equipped with a rectangular aperture and bent into a loop shape. Subsequently the mutually joining conductor tracks are electrically connected with each other, for example by soldering.

In case of pulse transformers utilized for high pulse repetition rates, for example for 16 MHz, it is advantageous to shield the windings of the transformer against external electromagnetic interferences. Such a shielding, however cannot be readily applied to conventional transformers. Therefore, it is an object of the invention to provide a pulse transformer which can be manufactured in a simple fashion, the windings of this transformer being shielded against all externally arriving electromagnetic interferences. In particular, the objective resides in shielding even against those interferences which are introduced via line screening units and/or grounded line sections of connecting leads etc.

It has been found that the pulse transformer of this invention exhibits very good electrical properties; that the digital signals transmitted by the transformer are hardly affected by external interferences; and that the manufacturing costs are substantially reduced as compared with the conventional pulse transformers. Furthermore, in the use of the pulse transformers, simplifications are attained in the electronic connecting system and elegant possibilities are opened up for combining signal and supply lines, satisfying the highest safety requirements.

Figure 2:
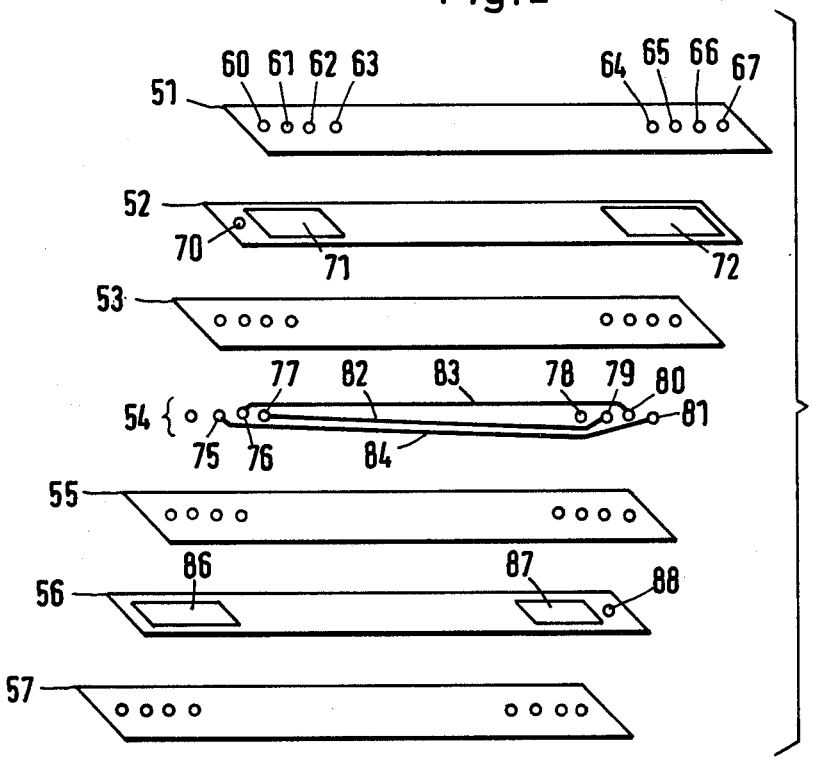
Figure 3:
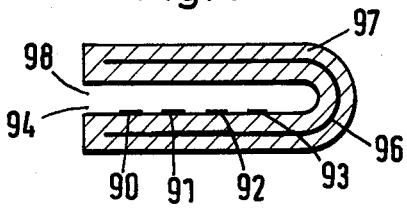
Figure 4A:
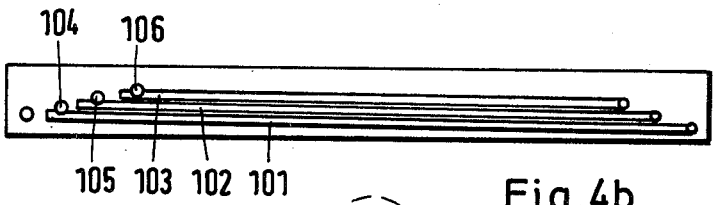
Figure 4B:
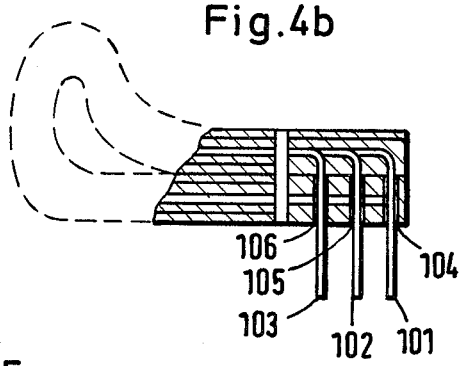
Figure 5:
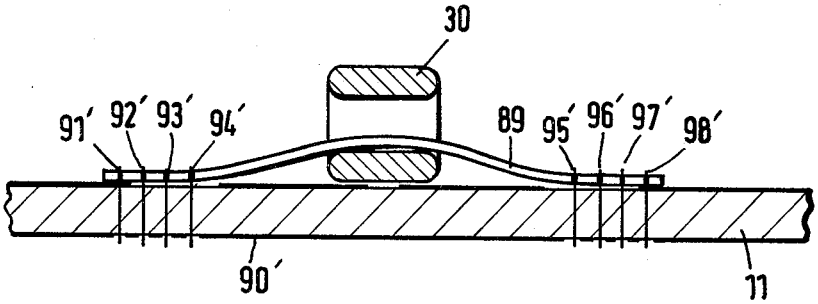
Figure 6:
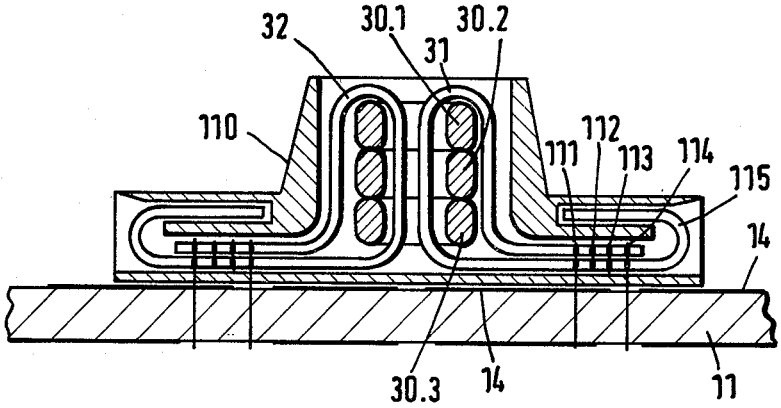

The invention will be explained in greater detail below by way of examples with reference to 6 figures wherein:

FIG. 1 is a sectional view of a pulse transformer mounted on a supporting printed circuit board, FIG. 2 is an exploded view of a multilayer, flexible printed circuit board, FIG. 3 is a section through a flexible printed circuit board, FIG. 4*a* is a top view of a flexible unit with insulating wires, FIG. 4*b* is a lateral view of the same unit, FIG. 5 is a sectional view of a second pulse transformer mounted on a supporting printed circuit board, FIG. 6 shows a mounting for a pulse transformer.

FIG. 1 shows a section through a pulse transformer mounted on a supporting printed circuit board. Numeral 11 denotes this printed circuit board, composed, as a three-layer board, of insulating material 12, a lower conductor layer 13, an upper conductor layer 14, and a middle conductor layer 15. A coaxial cable 20 is connected to the printed circuit board 11 preferably by way of a coaxial plug. The central conductor 21 of the coaxial cable 20 is conductively connected via a cutout 22 in the upper conductor layer 14 with a conductor track in the middle conductor layer 15. Numeral 23 denotes a cross connection by way of which the shielding of the coaxial cable 20 is connected to the lower (13) and to the upper conductor layer 14 of the supporting printed circuit board 11.

The conductor track 15 in the central conductor layer is dimensioned in its width so that, together with the spacing between the layers 15, 13, and 14, as well as with the electrical properties of the insulating material 12, a wave impedance results corresponding to that of the coaxial cable 20. This wave impedance can amount, for example, to 75Ω.

Numeral 30 is a seamless, ferromagnetic toroidal core; two flexible printed circuit boards 31 and 32 are passed through the aperture of this core to form the primary and secondary windings of a pulse transformer. Both printed circuit boards are bent into a loop shape and are connected to the supporting printed circuit board 11 mechanically and at least in part electrically by way of pins 36–39 and 46–49, respectively. Thus, the pin 39, for example, connects the lower (13) and upper (14) conductor layers of the supporting printed circuit board 11 with corresponding layers of the flexible printed circuit board 31. The pin 36 connects the conductor track 15 with the beginning of the turn of the primary winding. The remaining pins 37 and 38 connect exclusively points of the flexible printed circuit board 31 with one another. The manner in which the connections are established will be discussed in detail below with reference to FIG. 2.

A nonconductive intermediate zone 42 is arranged between the upper conductor layer 14 on the right-hand side of FIG. 1 and the corresponding layer 44 on the left-hand side. A corresponding intermediate zone 41 on the underside of the printed circuit board 11 corresponds to this intermediate zone 42. By these intermediate zones 41 and 42, an electric separation is effected between the conductor regions 13 and 14 lying at the potential of the coaxial cable jacket and the conductor regions 43 and 44, lying at the desired reference potential of an electronic circuit, for example an amplifier or driver circuit. Thereby a complete electric separation is achieved between the input and output regions of the pulse transformer.

FIG. 2 shows an exploded view of the printed circuit board denoted by 31 in FIG. 1, having the shape of a flat strip. Numerals 51–57 are seven superimposed and mutually welded-together layers, of which the layers 51, 53, 55, and 57 are made of an insulating material and the layers 52, 54, and 56 consist of a metal, for example copper. All of the layers have a clear longitudinal orientation which is large as compared with their transverse direction. All of the layers lack holes or connections in the central zone; such holes or connections are, rather, provided at the ends of the multilayer printed circuit board. The dimensions of the printed circuit board can be, for example, $0.5\times5\times50$ mm.

The upper metal layer 52 exhibits two cutouts 71 and 72 as well as a soldered connection 70. The lower metal layer 56 has corresponding cutouts 87 and 86, as well as a soldered connection 88, arranged in mirror-image symmetry with respect to the corresponding cutouts and connections of layer 52. The central metal layer 54 comprises, for example, three conductive tracks 82–84, defined by respectively two soldered connections 75 through 81, arranged in two rows in series in the longitudinal direction.

All of the layers 51–57, superimposed in the welded-together condition, exhibit penetrating holes 60–67 at the locations where a soldered support is arranged in any of the layers, these holes being plated throughout, i.e. the walls of these holes are metallically conductive and are in electrical connection with the soldered supporting point or points in the various metal layers 52, 54 and/or 56.

The pulse transformer is assembled by pushing the flexible printed circuit boards 31 and 32 through the toroidal core 30 and then bending these boards into the right loop shape in the way shown in FIG. 1. By introducing the pins 36–39 and 46–49, respectively, as illustrated in FIG. 1, into the superimposed holes 63 and 64, 62 and 65, 61 and 66 and 60 and 67, respectively, and by soldering these pins together with the holes, which latter are plated throughout, the following connections are established with the printed circuit board 11:

Pin 39 connects the soldered supporting points 70, 81, and 88 via holes 60 and 67 to the conductor layers 13 and 14 of the supporting printed circuit board 11.

Pin 38 connects the soldered supporting points 75 and 80 with each other by way of holes 61 and 66.

Pin 37 connects the soldered supporting points 76 and 79 with each other by way of holes 62 and 65.

Pin 36 connects the soldered supporting points 77 and 78, via holes 63 and 64, with the conductive track 15 of the supporting printed circuit board 11.

In this way, a three-turn winding is produced connected to the central conductor 21 of the coaxial cable 20 via the conductive track 15 and the pin 36. The three turns consist of the conductor tracks 82, 83, and 84, as well as the pins 37 and 38. The end of this winding is connected via the pin 39 with the conductor layers 13 and 14 of the supporting printed circuit board 11 and thus to the potential of the jacket of the coaxial cable 20.

The layers 52 and 56 of the flexible printed circuit board 31 are connected, in the soldered condition, via respectively one point with the conductive layers 13 and 14 and constitute two shielding layers which almost completely surround the aforedescribed winding. These shielding layers, though bent into a ring shape, do not form closed rings. The bending direction of the shielding layers with respect to their connection points 70 and 88, respectively, is opposite, and their widths are so large that they broadly cover the conductor tracks 82–84 lying therebetween and forming the winding. Thus, taking the small layer thicknesses of the layers 53 to 54 into account, it is ensured that the conductor tracks are shielded all around against electromagnetic interferences.

In the pulse transformer corresponding to FIG. 1, the primary and secondary windings can be constituted by identical flexible printed circuit boards 31 and 32. In this case, a pulse transformer is obtained, the transformation ratio of which is 1:1. By the use of differing printed circuit boards, however, other transformation ratios can also be established in a simple way. Furthermore, in case of four conductor tracks of the middle layer 54, for example, a connecting pin can be provided as a central tap, whereby a winding with two plus two turns is produced.

Besides the exemplary embodiment of the invention shown in FIGS. 1 and 2, a number of variations are possible. One of these variations resides in constructing the layers 52 and 56 of the flexible printed circuit board to be identical, rather than in mutual mirror-image symmetry. When the printed circuit board is then bent into a loop, two shielding layers are thus produced which have the same bending direction with respect to their connecting points.

Instead of a layer 54, exhibiting three parallel conductor tracks 82–84, a conductor layer can be employed having more or less than three conductor tracks. Furthermore, in place of one such layer, several layers of this type can be arranged in superposition, whereby windings having more than three turns can be formed.

Instead of a printed circuit board with three metal layers corresponding to FIG. 2, a double-layer board can be provided as shown in FIG. 3. In this board, the conductor tracks 90–93, four in number, for example, which exhibit connecting points at their two ends and serve for producing the winding, are arranged on one board side 94. On the other board side a single, larger-area metal layer 96 is provided. By folding the board in parallel to the conductive tracks 90–93, one half of the layer 96 is placed on top of these conductive tracks 90–93, whereas the other half remains on the underside. In this way, a unit is formed consisting of mutually insulated conductive tracks, which unit is shielded all around toward the outside. An insulating cover layer 97 effects insulation toward the outside and makes it possible to perform a welding connection at the otherwise open fold end 98.

A unit having the same function can be constructed in a similar way as the above-described, folded printed circuit board wherein the conductor tracks for forming the winding consist of insulated wires, for example varnished wires. FIG. 4*a* shows a top view of these wires 101–103, lying offset in parallel to one another; these wires are held on the topside and underside by respectively one insulating layer carrying a conductor layer, so that, in turn, a unit is provided wherein centrally disposed conductor tracks with connecting points at both ends are shielded toward the outside by shielding layers. The connection points can be constituted either by extending the wires 101–103 laterally out of the unit, or by providing drilled holes 104–106 arranged in such a way that respectively one wire is drilled into from the side and thus insulated. The thus-formed holes can be plated throughout to be electrically conductive and thus correspond entirely to the holes 60–67 in FIG. 2.

FIG. 4*b* shows such a unit, bent into a loop. The projecting wires 101–103 are soldered with their insulated ends directly into the holes 104–106. The pins 36–39 and 46–49 shown in FIG. 1 can thus be dispensed with.

Instead of a single, closed ferrite ring, the transformer core can also be two or more ferrite cores arranged coaxially side-by-side, the flexible printed circuit boards 31 and 32 passing through the apertures of these cores.

The coaxial cable 20 can be attached exclusively mechanically to the supporting printed circuit board 11, and the central conductor 21 of this cable can be connected directly to the beginning of the winding of the flexible printed circuit board 31.

To ensure a satisfactory dielectric strength with respect to higher voltages, the shielding layers 52 and 56 of the flexible printed circuit board can be narrowed in the middle in the manner of a dumbbell, in order to obtain an improved insulating capacity of the welded connection of the insulating layers at the bending zones.

Instead of penetrating the ferrite core in the manner of a loop, the flexible printed circuit boards 31 and 32 can also penetrate the core in the manner of a slight arc corresponding to FIG. 5. In this case, the flexible printed circuit board 89, for example, is attached electrically and mechanically on both sides of the toroidal core 30 by means of pins 91'–98' on a supporting printed circuit board 11. The conductor tracks corresponding to 82, 83, and 84 in FIG. 2, can either be supplemented here by conductor tracks 90' on the supporting printed circuit board 11, or by a second flexible printed circuit board which does not pass through the toroidal core 30.

FIG. 6, finally, shows in a schematic view a mounting 110 for a complete pulse transformer, composed of three coaxially superimposed, seamless ferrite cores 30.1, 30.2, and 30.3, and two winding units bent into loop shape, for example printed circuit boards 31 and 32 of the type described in connection with FIG. 2. The pins 112 and 113 of the right-hand unit connect, in the manner described above, the conductor tracks forming the winding and fix the unit to the mounting. The remaining pins 111 and 114 are extended from the mounting 110 and serve as solder pins for connection with the supporting printed circuit board 11. The winding unit exhibits an extension 115 exhibiting an additional shielding layer electrically connected with the shielding layers of the flexible printed circuit board 31. This extension 115 is bent in the manner of a cover plate over the top ends of the pins and shields the latter electrically. At the bottom, the layer 14 of the supporting printed circuit board 11 takes over the corresponding function. Thereby a further improvement in the shielding properties is attained. Corresponding remarks apply in connection with the second winding unit 32.

The winding direction of the loops of the two winding units of a pulse transformer can, of course, be in the same sense, corresponding to FIG. 6, or, in a somewhat modified geometry, also in the opposite sense.

Pulse transformers of the above-described type are utilized, for example, as isolation transformers between an electronic circuit arrangement and a transmission line for the transmission of fast digital signals. The transmission line can be constructed, as shown in FIG. 1, as a coaxial cable 20 or as a different cable suitable for digital signals, for example a four-wire line consisting of two pairs of cable wires. In addition to the digital signals, a supply current can flow along this line, in a conventional fashion.

The terms and expressions which have been employed herein are used as terms of description and not of limitation, and there is no intention, in the use of such terms and expression, of excluding any equivalents of the features shown and described or portions thereof but it is recognized that various modifications are possible within the scope of the invention claimed.

What is claimed is:

1. A pulse transformer comprising at least a toroidal, seamlessly closed core (30, 30.1–30.3) and with primary (31) and secondary windings (32) wherein the turns of the windings (31,32) are constituted by elongated conductors (82–84, 90–93, 101–103) which are applied in side-by-side relationship to flexible, plate-shaped supports of insulating material (51,53,55,57,97), wherein the supports, including the conductors (82–84, 90–93, 101–103) are passed through the core (30, 30.1–30.3) and bent into the shape of a loop, and wherein the ends of the conductors (82–84, 90–93, 101–103) are electrically connected to one another, each support consists of at least one layer of insulating material (51, 53, 55, 57, 97) bearing at least two layers of conductors (52, 54, 56, 90–93, 96, 101–103);

each conductor (52, 56, 82, 83, 84, 90–93, 96, 101–103) exhibits either at one end or at both of its ends connecting points (70; 88; 77, 79; 76, 80; 75, 81), by means of which the conductors (52 . . . ) can be electrically connected with one another and with other conductors;

the conductors (82, 83, 84, 90–93, 101–103) with two connecting points are narrower than the conductors (52, 56, 96) with one connecting point and are arranged so that they are covered to a predominant part toward the outside by the conductors (52, 56, 96) with one connecting point and thus are electrically shielded thereby.

2. A pulse transformer according to claim 1, characterized in that the supports and the conductors are constructed as a strip-shaped, multilayer, printed circuit board (FIGS. 2 and 3).

3. A pulse transformer according to claim 2, characterized in that:

the printed circuit board (FIG. 2) exhibits three layers of conductors (52, 54, 56), the central layer of conductors (54) exhibits more than one conductor (82, 83, 84) with two connecting points, wherein the connecting points (77, 79; 76, 80; 75, 81) of the essentially parallel-disposed conductors (82, 83, 84) are arranged one behind the other in the longitudinal direction, the outer layers of conductors each have one conductor (52, 56) with one connecting point, and these conductors (52, 56) with one connecting point have cutouts (71, 72; 86, 87) arranged in such a way that the connecting points (77 . . . ) of the conductors (82, 83, 84) with two connecting points are not covered over.

4. A pulse transformer according to claim 2, characterized in that:

the printed circuit board (FIG. 3) has two layers of conductors, the conductor (96) of the one layer has one connecting point and the conductors (90 . . . 93) of the other conductor layer have two connecting points, and the printed circuit board is folded in parallel to its longitudinal extension in such a way that the conductor (96) with one connecting point substantially covers the conductors (90 . . . 93) with two connecting points all around.

5. A pulse transformer according to claim 3 or 4, characterized in that the printed circuit board has connecting holes (60 . . . 67) wherein connecting pins (36 . . . 39; 46 . . . 49; 111 . . . 114) are mounted, by means of which pins the conductors of the printed circuit board are connected with one another and are connectable with other conductors (FIGS. 1, 2 and 6).

6. A pulse transformer according to claim 5, characterized in that the printed circuit board has an extension (115) comprising a conductor connected to a connector with one connecting point, and this extension is bent, as a shielding means, in the manner of a cover plate over the uncovered ends of the pins on one side (FIG. 6).

7. A pulse transformer according to claim 1, characterized in that:

the support is the insulating layer of a folded, single-layer printed circuit board, the conductor of which has one connecting point, and the conductors with two connecting points are isolated wires arranged parallel one to the other inside the folded circuit board the ends of the wires extending to the outside (FIGS. 4*a* and 4*b*).

8. A pulse transformer according to claim 1, characterized in that the connecting points (70, 88) of the independent conductors (52, 56) with one connecting point are arranged at mutually corresponding ends of the conductors.

9. A pulse transformer according to claim 1, characterized in that the connecting points (70, 88) of the independent conductors (52, 56) with one connecting point are arranged at ends of the conductors which do not correspond to each other.

10. A pulse transformer according to claim 1, characterized in that the core is composed of three independent, coaxially arranged ferrite cores (30.1, 30.2, 30.3) (FIG. 6).

* * * * *